US008540269B2

(12) United States Patent
Hembise et al.

(10) Patent No.: US 8,540,269 B2
(45) Date of Patent: Sep. 24, 2013

(54) MECHANICAL CONNECTION DEVICE BETWEEN A MOTORIZED VEHICLE AND WORKING EQUIPMENT

(75) Inventors: Dominique Hembise, Plaisir (FR); François Sylvain Crosnier, Voisins-le-Bretonneux (FR); Alain Guesdon, Noisy-sur-Ecole (FR)

(73) Assignee: MBDA France, Paris (FR)

( * ) Notice: Subject to any disclaimer, the term of this patent is extended or adjusted under 35 U.S.C. 154(b) by 183 days.

(21) Appl. No.: 13/132,043

(22) PCT Filed: Dec. 8, 2009

(86) PCT No.: PCT/FR2009/052438

§ 371 (c)(1),
(2), (4) Date: May 31, 2011

(87) PCT Pub. No.: WO2010/067002

PCT Pub. Date: Jun. 17, 2010

(65) Prior Publication Data

US 2011/0233898 A1 Sep. 29, 2011

(30) Foreign Application Priority Data

Dec. 10, 2008 (FR) ..... 08 06922

(51) Int. Cl.
*B60D 1/48* (2006.01)

(52) U.S. Cl.
USPC ..... 280/495; 280/504

(58) Field of Classification Search
USPC ..... 280/481, 482, 483, 486, 491.1, 491.2, 280/495, 504
See application file for complete search history.

(56) References Cited

U.S. PATENT DOCUMENTS

| | | | | |
|---|---|---|---|---|
| 2,646,287 | A * | 7/1953 | Kytola | 280/481 |
| 5,786,542 | A | 7/1998 | Petrovich et al. | |
| 6,364,338 | B1 * | 4/2002 | Whitley | 280/493 |
| 2002/0101057 | A1 * | 8/2002 | Hermann et al. | 280/504 |

FOREIGN PATENT DOCUMENTS

FR 2 678 554 1/1993

OTHER PUBLICATIONS

International Search Report completed Mar. 23, 2010 and mailed Mar. 30, 2010 from corresponding International Application No. PCT/FR2009/052438, filed Dec. 8, 2009 (4 pages).
Written Opinion completed Mar. 23, 2010 and mailed Mar. 30, 2010 from corresponding International Application No. PCT/FR2009/052438, filed Dec. 8, 2009 (11 pages).

* cited by examiner

*Primary Examiner* — Tony Winner
*Assistant Examiner* — Jacob Knutson
(74) *Attorney, Agent, or Firm* — Klein, O'Neill & Singh, LLP

(57) ABSTRACT

The present disclosure relates to a mechanical connection device between a motorized vehicle and working equipment. According to the present disclosure, the device includes a rigid plate mounted by means of axles in the tow rings of the vehicle and bearing adjustable skids that are applied against a transverse surface of the vehicle, such as to abutt the connection device to the vehicle, thereby securing the same.

20 Claims, 2 Drawing Sheets

MECHANICAL CONNECTION DEVICE BETWEEN A MOTORIZED VEHICLE AND WORKING EQUIPMENT

CROSS-REFERENCE TO RELATED APPLICATION(S)

This is a national phase application under 35 U.S.C. §371 of PCT Application No. PCT/FR2009/052438, filed Dec. 8, 2009, which claims the benefit of French application Ser. No. 08/06922 filed Dec. 10, 2008, the contents of which are expressly incorporated herein by reference.

FIELD OF ART

The present disclosure relates to a mechanical connection device adapted to be arranged between a motorized vehicle and a working equipment or system mounted on rolling members, as well as a motorized assembly comprising the vehicle and the equipment connected to each other via said connection device.

BACKGROUND

More particularly, although not exclusively, the mechanical connection device is intended for equipping military vehicles or devices such as those pushing a mine-clearing driving equipment for detecting and detonating improvised explosive devices buried into the ground or laid thereon, but, of course, it could be mounted on any other type of vehicles for other purposes.

As known, known mine-clearing equipment for fighting against improvised explosive devices comprise a supporting structure bearing on which there are mounted, more particularly, at some safety distance from the motorized vehicle, triggering decoys for explosive devices. Such a structure relies on rolling members, such as wheels, and is made integral with the front of the motorized vehicle.

The connection between the supporting structure of the equipment and the front of the vehicle is implemented from a large number of components, such as joints, small rods, supports, etc. to be adapted and mounted directly on the front of the vehicle through numerous and difficult assembling, drilling, welding, etc. operations. Taking into account the various shapes and dimensions of the equipment to be pushed and of the motorized vehicles, each connection is often specific and structurally and functionally different, and requires a particular study for the adaptation of a given pushed equipment to such a motorized vehicle, so multiplying the type of components to be provided, increasing the costs and thus requiring a consistent supply.

SUMMARY

The present method, system and device aim at solving such drawbacks and relate to a mechanical connection device, the design of which makes it possible to adapt it to most motorized vehicles, including of the military type, and to be able to directly mount on the latter the pushed equipment without implementing long and tiresome operations on the motorized vehicle.

Moreover, as known, most military vehicles are provided, at the front, with towing rings, for usual towing and slinging purposes. Such towing rings provided on such vehicles are dimensioned so as to be submitted to very high stresses, significantly higher than those required for the application of the present method, system and device and have identical general dimensions, even rather close from one vehicle to the other. They are moreover arranged in the lower front part of vehicles generally on a bumper or a weathering being a strong area of the vehicle, this being particularly suited for anchoring the equipment.

Thus, taking all this into account, the mechanical connection device being the object of the present method, system and device and intended for connecting a motorized vehicle provided, on a transverse surface thereof, with two parallel towing rings, the eyelets of which are aligned, to a working equipment with rolling members moved by said vehicle, is remarkable, according to the present method, system and device in that it comprises:

a rigid plate able to receive said equipment and to reach a position substantially between said two towing rings and in two lateral sides of which holes are arranged, being able to come opposite said ring eyelets;

pins being respectively housed in said aligned holes and eyelets so as to carry said plate; and abutment skids arranged between said transverse surface of the vehicle and said plate, and associated with the latter, movably, by a controllable adjustment means, so as to space apart from said plate and apply against said transverse surface of said vehicle.

Thus, advantageously, the existing towing rings of vehicles are used for simply adapting the mechanical connection device of the present method, system and device then acting as a standard interface between most vehicles and rolling materials.

Furthermore, as the rigid plate is retained through pins inserted in the eyelets of the rings integrally formed with the vehicle, the abutment skids can apply strongly against the transverse surface of the vehicle through the action of said securing means, until the abutment effort of the skids on said surface results in the connection device being unable to move whatever the intensity of the external mechanical actions so as to get a buttressing phenomenon.

It is also noticed, that there is no need to implement assembling, drilling, welding operations or other in the structure of the vehicle for securing the connection device and that the assembling and, accordingly, the dismantling of the latter, and therefore the removability of the device, are particularly easy without affecting the structure of the vehicle, which is particularly valuable. The connection device, if it has not been damaged by an explosive device, could therefore be used again on another vehicle or remain permanently on the latter.

Preferably, each pin is mounted in said respective lateral hole of the rigid plate so as to make up with the latter a linear actuator being controllable for moving said pin between an extended position associating said plate with said towing ring and a retracted position separating said plate from said ring, and reciprocally. Thus, the pins act as locks, allowing, more particularly, the mechanical connection device of said towing rings to be easily assembled and dismantled.

Advantageously, controlling each of the pins occurs from a power source.

In particular, each pin could then be submitted, on the one hand, to the action of an elastic member arranged in said lateral hole of the plate and sliding said pin for the engagement in said corresponding eyelet and, on the other hand, to the action of said power source acting to meet said elastic member so as to retract said pin in its lateral hole. Indeed, as assembling the pins does require any significant effort, a single spring is sufficient for having the pin slide in the corresponding eyelet. On the other hand, dismantling, more particularly when the working equipment has been damaged, resulting in deformations on the connection device, could require a more significant energy for retracting the pins, delivered by the action of the power source.

Advantageously, said power source is hydraulic or pneumatic and is defined by an accumulator able to be loaded from a pump or a pressurized fluid circuit of said vehicle.

Said power source could also be of the electrical type.

According to another feature of the mechanical connection device, said abutment skids are controlled by a threaded engagement and are defined by at least one threaded rod, being integral with each skid and crossing, through its free end, said plate maintained in position by said pins, and by a nut cooperating with the free end of said rod. Thus, abutments of the pins in the eyelets are used for buttressing against the front transverse surface of the vehicle by means of the abutment skids, imparting a particularly strong connection of the device to the vehicle.

For example, each abutment skid could comprise a small plate and a liner arranged on said small plate and cooperating with said transverse surface of the vehicle.

Furthermore, said abutment plate comprises a joint intended for allowing anchoring said working equipment. Herein, the joint may alternatively be termed an anchor. In a preferred embodiment, said joint comprises at least two bearings being integral with said plate on the side opposite that provided with said abutment skids, and aligned in parallel to the mounting pins of said plate on said rings, said bearings being able to receive pins associating or releasing said working equipment from said plate. Herein, the bearings may alternatively be termed anchor points.

Controlling the pins associating the working equipment with the plate of the connection device could occur advantageously identical to that of said pins associating the vehicle with the plate of such a connection device.

Thus, the working equipment could be separated from the connection device while maintaining the latter associated with the vehicle.

Furthermore, in another embodiment, the device could comprise controllable pyrotechnic loads associated with the pins connecting said plate to the towing rings of the vehicle and to the working equipment. Thus, the action of such loads at the level of the pins results in the device being separated from said working equipment and/or from said vehicle.

The present method, system and device also relate to a motorized assembly of the type comprising an engine vehicle before which a working equipment is mounted with rolling members. Advantageously, the assembly is remarkable in that it comprises a mechanical connection device such as defined herein above.

BRIEF DESCRIPTION OF THE FIGURES

The FIGS. of the appended drawing will better explain how the present method, system and device can be implemented. In these FIGS., like reference numerals relate to like components.

DETAILED DESCRIPTION

Figure 1:
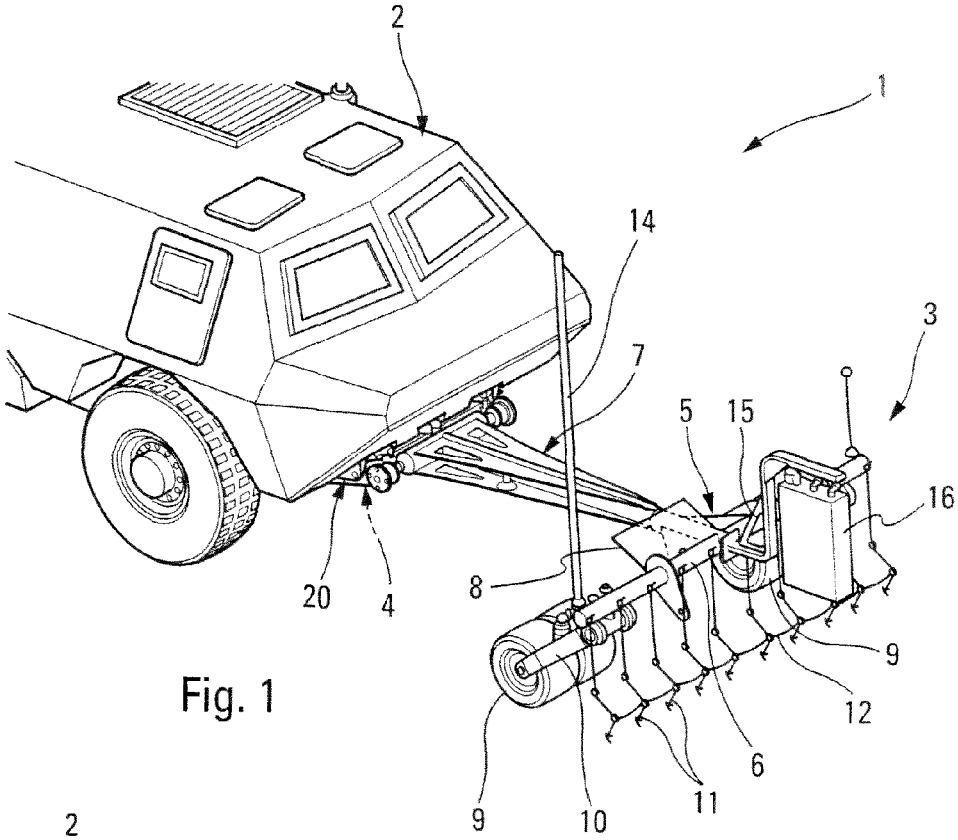
FIG. 1 is a partial perspective view showing a motorized assembly comprising, for connecting the working equipment to the engine vehicle, a mechanical connection device according to the present method, system and device.

The motorized assembly 1 shown on FIG. 1 comprises, in this example, a military vehicle or device 2 of the armoured type and a rolling working equipment 3 arranged before the military vehicle 2 by means of a mechanical connection device 4 according to the present method, system and device and intended, in this present preferred embodiment, for detecting and triggering not shown improvised explosive devices, partially or completely buried in the ground.

Briefly, the equipment 3, pushed by the vehicle 2, comprises:

- a front structure 5 with a transverse beam 6 at least as wide as the vehicle 2;
- a rear longitudinal structure 7, hinged on the one side to the connection device 4 and bearing, on the other side, the transverse beam 6 of the front structure, so as to position the latter at an appropriate distance from the vehicle 2 for protection and safety purposes;
- rolling members 9, such as aligned twin wheels, carried by means of arms 10 hinged to the beam 6 and having a position stabilisation, mobility and decoying function of mechanical sensors for triggering improvised explosive devices;
- claws 11 issued from the beam 6 and catching, via their free ends, wires and filaments lying on the ground;
- a transverse sling 12 connecting the claws 11 so as to intercept antennas;
- a pole 14 intercepting air wires and fastened to the beam;
- a platen 15 mounted on the beam and bearing for example an infrared decoy 16; and
- an interface member 8 arranged on the front structure 5 for carrying a not shown detecting, decoying or jamming system.

Of course, the pushed equipment 3 for detecting and triggering improvised explosive devices could have a different structure and be provided with other equipment.

Figure 2:
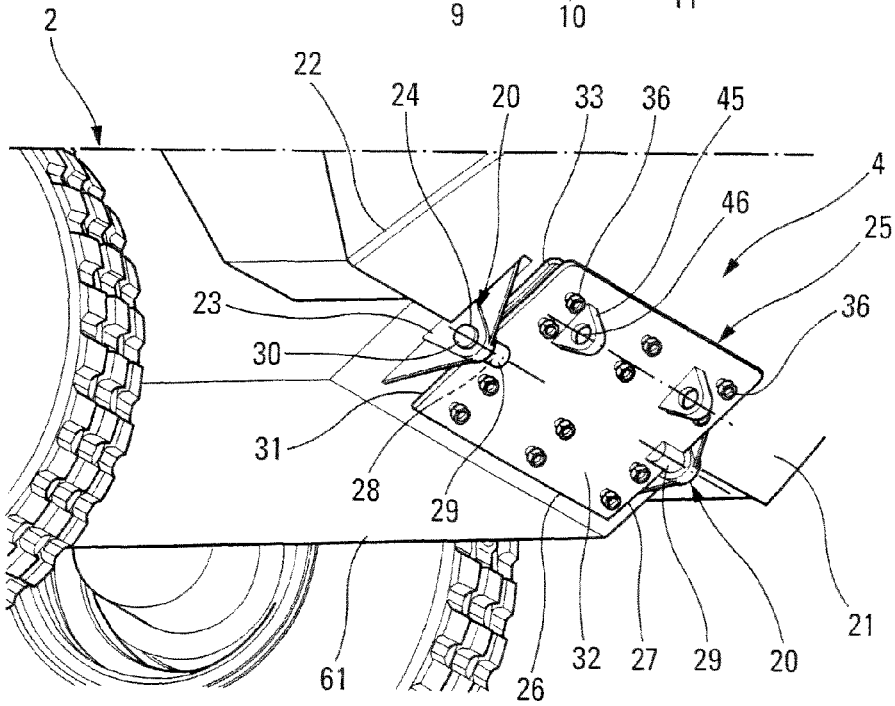
FIG. 2 is a bottom perspective view of said connection device mounted at the front of the vehicle.

As shown on FIG. 2, the connection device 4 of the present method, system and device could be advantageously mounted between the two identical towing rings 20 usually arranged at the front of military motorized vehicles and previously described. In particular, such rings 20 are issued from the tilted transverse surface 21 of the weathering or bumpers 22 (for some vehicles) of the vehicle 2 and are each defined by a body or fitting 23 being integral with and perpendicularly projecting with respect to the front transverse surface 21, and provided with a circular eyelet 24 for anchoring a towing device. The eyelets 24 of those rings 20 are perpendicularly aligned to the vertical longitudinal plane of the vehicle, i.e. parallel to the transverse surface 21.

Thus, the connection device 4 comprises a rigid plate 25 having a substantially rectangular shape in this embodiment, the length of the large sides 26 of which corresponds to the spacing between the two rings 20 so as to be able to be mounted therebetween. To this end, the plate 25 has on its two lateral sides or small sides 27, substantially in the center thereof, holes 28 (FIGS. 2, 4A, 4B and 5) arranged in respective cylindrical bosses 29 of said sides 27, the diameter of which could correspond to that of the eyelets. And pins 30 are respectively inserted in the aligned eyelet 24-hole 28 assemblies for supporting the rigid plate 25 with respect to the rings 20. Thus, the rigid plate has one 31 of its main sides facing the tilted transverse surface 21 of the vehicle 2 and the other side 32 facing outwards and receiving, as will be set forth later, the longitudinal structure 7 of the working equipment to be pushed 3.

The connection device 4 further comprises abutment skids 33 (FIGS. 2, 3 and 5) being movably connected with respect to the rigid plate 25 and to be used for applying against the tilted transverse surface 21 of the front of the vehicle 2. They are thus arranged between such a transverse surface 21 and the inner side 31 of the plate 25, facing the vehicle, and parallel to such a side.

In this embodiment, the skids 33 are identical, have a rectangular shape and are three in number while being arranged vertically in the higher part of said rigid plate 25 with respect to the assembly pins 30 thereof in the rings, the one in the middle and the two others near lateral sides 27.

Each abutment skid 33 comprises a small rigid plate 34 on which there is secured, by any appropriate means, a liner 35 made in an appropriate material, coming in contact with the front transverse surface 21 of the vehicle.

In order to prevent the small rigid plate from oscillating with respect to the rings and to firmly apply the mechanical connection device against the front of the vehicle via its skids, the device 4 comprises a controlling means 36 associating each skid 33 with the plate 25, and more particularly in the illustrated example, two identical controlling means for each skid.

Figure 3:
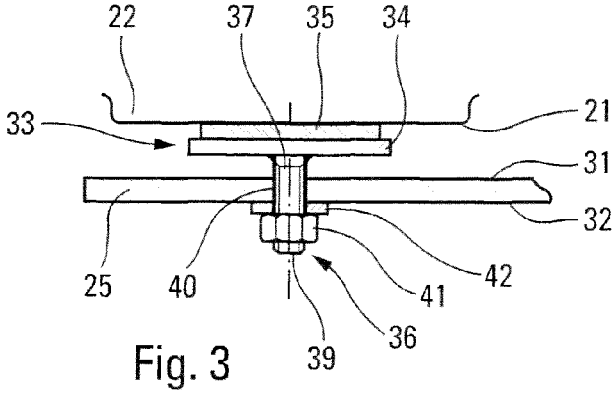
FIG. 3 shows, in a longitudinal section, an adjustment means for securing a skid to the vehicle by means of the rigid plate of the connection device.

In the embodiment shown on FIGS. 2 and 3, the controlling means 36 comprises a threaded rod 37 being integral perpendicularly, through welding or other, with the external side 32 of the small plate of each skid and crossing, via its free end 39, a passage 40 arranged in the rigid plate 25, and a clamping nut 41 mounted on the threaded end 39 of the rod.

Mounting the mechanical connection device 4 at the front of the vehicle 2 does not involve any difficulties. The skids 33 are first associated with the rigid plate 25 while introducing the threaded rods 37 of each of them in the respective passages 40 of the plate, then mounting the nuts 41 with their washers 42 on the free ends 39 of the rods. The skids 39 are afterwards adjusted to the closest to the side 31 of the plate. The latter is presented between the two rings 20 so as to have the eyelets 24 coincide with the lateral blind holes 28 of the plate. The pins 30 are engaged into the respective holes 28 and eyelets 24 with a preferably gliding adjustment. Then, the skids are brought, via their liners 35, against the front transverse surface 21 of the vehicle 2 and, as the plate 25 is maintained fixedly in position by the pins 30, the action of the nuts 41 on the threaded rods tends to space apart the plate of the transverse surface 21 being thereby in constraint against the pins 30 with an higher effort than the running efforts necessary to moving the motorized assembly 1.

Thus, the eyelets of the rings, via the pins, act as an abutment for the plate so as to drive the buttressing of the skids against the front transverse surface of the vehicle, thus imparting to the mechanical connection device 4 a total and reliable securing position, without either impairing or modifying the structure of vehicle 2. Thus, it can be particularly easily and rapidly mounted, and dismantled.

Furthermore, it can be seen on FIG. 2, that the rigid plate 25 comprises, on the external side thereof 32, two identical jointing bearings 45 for mounting the working equipment 3 and arranged according to an pin perpendicular to the vertical longitudinal symmetry plane of the vehicle. Those two bearings 45 are located in the upper part of the plate 25, near its lateral sides, and are provided with aligned passing holes 46 parallel to the mounting pins 30 of the plate on the rings. Thus, in these passing holes 46, not shown jointing pins are mounted for associating, appropriately, as shown on FIG. 1, the rear of the longitudinal structure 7 of the working equipment 3 at the front of the engine vehicle 2 via the mechanical connection device 4 acting as an interface.

In another embodiment, sliding the jointing pins 30 of the rings 20 to the rigid plate 25 could be controlled, similarly to an electric or fluidic (hydraulic or pneumatic) powered jack actuator 47. In this case, each pin 30 corresponds to a piston rod 48 of the actuator 47, the body or cylinder 49 could be the boss 29 of the plate or could be arranged fixedly on the latter, replacing the boss. And the hole 28 is replaced by the two chambers 53, 54 bounded by the piston rod 48 in the body 49 of the actuator 47.

Figure 4A:
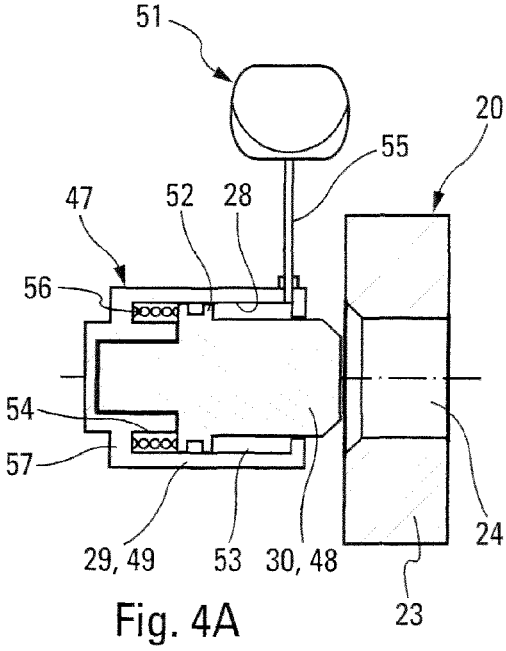
FIGS. 4A and 4B are longitudinal sections, according to an embodiment, of one of the supporting pins of the plate to the corresponding towing ring, before and after being introduced in the eyelet thereof.

Thus, it can be seen on FIG. 4A, one of said pins 30 forming the rod 48 of the actuator 47 and occupying a retracted position in the body 49 of the actuator, said pin 30 facing the eyelet 24 of the corresponding towing ring 20.

In this example, each pin 30 occupies a retracted position under the hydraulic or pneumatic action of a power source such as a membrane accumulator 51 loaded, at the start of the mission, with the motorized assembly 1, for example, from a not shown simple lever pump. The accumulator could also be loaded 51 from the pressure build-up of the hydraulic or pneumatic circuit of the vehicle 2 by a flexible connection, but the autonomous character of the accumulators is preferred in order to avoid tapping power from the vehicle.

In order to reach the retracted position, said pin 30 or rod 48 has an external annular shoulder 52 separating the body tightly into the first 53 and second 54 chambers and submitted, on the side of the first chamber 53, to the pressurized fluid issued from the accumulator 51 by a flexible connection 55 and, on the side of the second chamber 54, to a elastic member such as a compression spring 56 arranged between the bottom 57 of the body 49 of the actuator 47 and the annular shoulder 52. Thus, when the fluid pressure in the first chamber 53 applies on the external annular shoulder 52, it overcomes the action of the spring 56 which becomes compressed under the sliding pin 30 then occupying the retracted position illustrated on FIG. 4A.

Figure 4B:
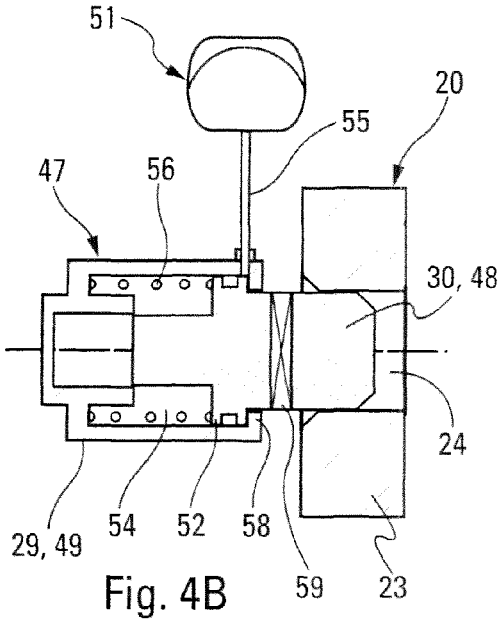

On the other hand, when the mechanical connection device 4 is to be assembled to the weathering or the bumper 22 of the vehicle, upon a mission, and the pins 30 are opposite the respective eyelets 24, the accumulators 51 are isolated from the chamber 52 being then brought to the atmospheric pressure (for example, by means of a not shown three way valve), dropping the pressure in the first chambers 53. Thereby, under the action of compression springs 56 that could have a low power, the pins 30 switch from the retracted position. FIG. 4A, to the extended position. FIG. 4B, slidably engaging, as a lock, in the eyelets 24 of the towing rings 20.

The external annular shoulder 52 of each pin comes then in abutment against a front internal annular shoulder 58 of the body.

Thus, using accumulators 51 is particularly advantageous when it is desired "to release" or to break away from the motorized vehicle 2, the working equipment 3, as well as the associated connection device 4, as a result of an improvised device explosion, leading to it being damaged, as said accumulators 51 are able to restore a high fluid energy for retracting the pins 30 and thereby overcome the buttressing and jamming that could be caused by the pushed equipment being damaged. Releasing occurs, for example, by inverting the position of the three way valve.

In another not shown embodiment, releasing the pins 30 could be achieved by pyrotechnic loads surrounding, for example, the pins or inserted therein, and able to be fired from the interior of the motorized vehicle.

Instead of acting on the pins 30 associating the connection device 4 with the towing rings 20 for releasing the working equipment 4, the jointing pins provided between the longitudinal structure 7 of the working equipment and the bearings 45 of the rigid plate of said device could obviously be used, and could be there too assimilated to actuator rods.

On these pins, there could also be arranged pyrotechnic loads 59 shown on FIG. 4B and known as such (fuse or other) for leading the working equipment 3 to separate from the mechanical connection device 4.

Figure 5:
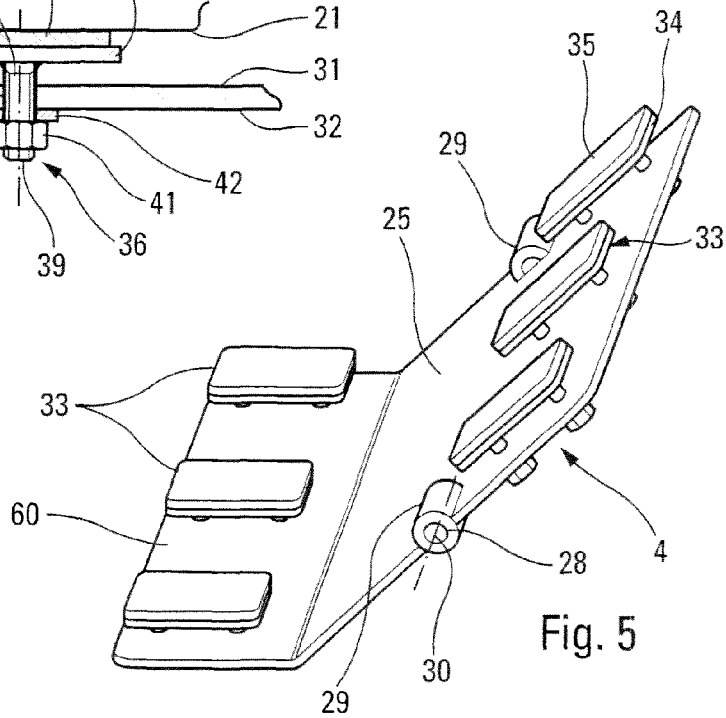
FIG. 5 is a perspective view showing another embodiment of said rigid plate of the connection device.

In the embodiment of FIG. 5, the rigid plate 25 comprises an extension part 60, bendingly extending the initial plate for being able to apply, via the skids 33 as well, against the bottom 61 of the structure of the motorized vehicle 2, extending the front tilted transverse surface 21 of the weathering.

The invention claimed is:

1. A mechanical connection device to connect a motorized vehicle and a working equipment, said mechanical connection device comprising:

a rigid plate defining a plane having a first side for facing the motorized vehicle when mounted to the motorized vehicle and a second side and is sized and shaped to rest between two towing rings located on the motorized vehicle;

bosses formed on the rigid plate and positioned on the rigid plate such that the two bosses align with the two towing rings when mounted to the motorized vehicle;

a plurality of spaced apart abutment skids attached to the rigid plate on the first side of the rigid plate to abut a surface of the motorized vehicle when mounted; and wherein each abutment skid has a movable plate having a first surface and a second surface that faces the rigid plate, the movable plate is mechanically adjustable so that the second surface of the movable plate can move closer to or further away from the first surface of the rigid plate.

2. The device according to claim 1, further comprising pins with each pin mounted in a respective boss; the pin and the boss creating a controllable linear actuator for moving each pin between an extended position engaging each pin with each towing ring and a retracted position separating each pin from each towing ring.

3. The device according to claim 2, wherein movement of the pins is controlled, at least in part, by a powered system.

4. The device according to claim 3, wherein each pin is biased toward engagement by an elastic member provided in each pin's corresponding boss and retracted by the powered system.

5. The device according to claim 3, wherein said powered system is hydraulic or pneumatic type and is defined by an accumulator able to be loaded from a pump or a pressurized fluid circuit.

6. The device according to claim 3, wherein said powered system is electric.

7. The device according to claim 1, wherein said abutment skids each comprises at least one rod comprising a threaded free end passing through a corresponding opening in said rigid plate and having a threaded nut cooperating with the threaded free end of said rod.

8. The device according to claim 1, wherein the movable plate of each abutment skid comprises a liner arranged on said movable plate, the liner configured to contact the motorized vehicle when the device is mounted.

9. The device according to claim 1, wherein said rigid plate comprises an anchor spaced from said bosses for engaging said working equipment.

10. The device according to claim 9, wherein the anchor comprises at least two anchor points, integrally formed with the rigid plate on the second side of the rigid plate, the anchor points comprising openings sized for pins connecting or releasing said working equipment from the mechanical connection device.

11. The device according to claim 1, further comprising pins connecting the rigid plate to the two towing rings; wherein controllable pyrotechnic loads are engaged to the pins connecting said rigid plate to the towing rings of the motorized vehicle.

12. The device according to claim 1, further comprising the motorized vehicle and the working equipment connected to the mechanical connection device.

13. The device according to claim 12, further comprising pins connecting the rigid plate to the two towing rings and controllable pyrotechnic loads associated with the pins to move the pins.

14. The device of claim 12, further comprising pins; wherein each pin is mounted in its respective boss, each pin and respective boss creating a controllable linear actuator for moving each pin between an extended position and a retracted position.

15. The device of claim 14, wherein the movement of the pins is controlled, at least in part, by a powered system.

16. The device of claim 15, wherein each pin is biased toward engagement by an elastic member and retracted by said powered system.

17. A mechanical connection device configured to connect a working equipment to a motorized vehicle, said device comprising:

a rigid plate defining a plane having a first side for facing the motorized vehicle when mounted and a second side and is sized and shaped to rest between two towing rings located on the motorized vehicle;

anchor points formed on the rigid plate for mechanically coupling the working equipment to the rigid plate;

a plurality of spaced apart abutment skids mechanically connected to the rigid plate on the first side of the rigid plate to abut a surface of the motorized vehicle when mounted; and wherein each abutment skid has a movable plate having a first surface and a second surface that faces the rigid plate, the movable plate being mechanically adjustable so that the second surface of the movable plate can move closer to or further away from the first surface of the rigid plate.

18. The mechanical connection device of claim 17, further comprising:

bosses coaxially formed on the rigid plate so that a longitudinal axis passing through a center of each of the bosses is parallel to the plane of the rigid plate and aligns coaxially with the two towing rings when the plate is mounted to the motorized vehicle; and pins located in said bosses configured to engage the two towing rings.

19. The mechanical connection device of claim 18, wherein movement of the pins is controlled, at least in part, by a powered system.

20. The motorized assembly of claim 19, wherein each pin is biased toward engagement by an elastic member.

* * * * *